US008381372B1

(12) United States Patent
Arnall

(10) Patent No.: US 8,381,372 B1
(45) Date of Patent: Feb. 26, 2013

(54) CAMMING CLAMP FOR GUNWALES OR PONTOON-BOAT RAILS

(76) Inventor: Randall E. Arnall, Springfield, MO (US)

( * ) Notice: Subject to any disclaimer, the term of this patent is extended or adjusted under 35 U.S.C. 154(b) by 139 days.

(21) Appl. No.: 13/065,460

(22) Filed: Mar. 22, 2011

Related U.S. Application Data

(60) Provisional application No. 61/340,824, filed on Mar. 22, 2010, provisional application No. 61/211,344, filed on Mar. 26, 2009.

(51) Int. Cl.
*B25B 7/04* (2006.01)

(52) U.S. Cl. ..... 24/569; 24/568; 24/328; 24/525; 24/516; 269/3; 269/6

(58) Field of Classification Search ..... 269/3, 6, 269/228; 81/138, 139, 143; 248/226.11, 248/228.2, 228.5, 230.2, 230.5, 231.31, 231.61, 248/316.2, 316.6; 24/524, 257, 568, 569, 24/525, 328, 513–516
See application file for complete search history.

(56) References Cited

U.S. PATENT DOCUMENTS

| | | | | | |
|---|---|---|---|---|---|
| 746,504 | A | * | 12/1903 | Hardy et al. | 81/143 |
| 1,006,057 | A | * | 10/1911 | Brown | 81/143 |
| 1,061,876 | A | * | 5/1913 | Showalter | 81/139 |
| 1,155,278 | A | * | 9/1915 | Rush | 81/143 |
| 1,169,750 | A | * | 1/1916 | Walsh | 81/143 |
| 1,367,456 | A | * | 2/1921 | Brown | 81/143 |
| 1,609,330 | A | | 12/1926 | Thibodeau | 440/103 |
| 1,988,240 | A | * | 1/1935 | Ellis | 269/220 |
| 2,026,001 | A | * | 12/1935 | Rapinet | 81/357 |
| 2,253,895 | A | * | 8/1941 | Denovich | 81/139 |
| 2,504,721 | A | * | 4/1950 | Ortman | 81/138 |
| 2,650,788 | A | | 9/1953 | Hulstein | 248/231.71 |
| 2,882,774 | A | * | 4/1959 | Guttfeld | 81/139 |
| 3,124,330 | A | | 3/1964 | Robinson | 248/228.2 |
| 3,745,329 | A | | 7/1973 | Runey, Jr. | 362/209 |
| 3,792,829 | A | | 2/1974 | Fickett | 248/354 |
| 4,352,668 | A | | 10/1982 | Beevers et al. | 114/344 |
| 4,528,768 | A | | 7/1985 | Anderson | 43/21.2 |
| 4,672,898 | A | | 6/1987 | Davidson | 108/6 |
| 4,674,798 | A | | 6/1987 | Oeth et al. | 297/411.36 |
| 4,786,022 | A | | 11/1988 | Grieshaber | 248/287.1 |
| 4,836,127 | A | | 6/1989 | Wille | 114/343 |
| 4,993,346 | A | | 2/1991 | Rupp | 114/255 |
| 5,222,420 | A | * | 6/1993 | Sorensen et al. | 81/487 |
| 5,389,466 | A | | 2/1995 | Inoue et al. | 429/178 |
| 5,492,258 | A | | 2/1996 | Brunner | 224/321 |
| 5,832,793 | A | * | 11/1998 | Collins | 81/138 |
| 5,845,885 | A | | 12/1998 | Carnevali | 248/118.1 |
| 6,474,632 | B1 | * | 11/2002 | Liou | 269/6 |
| 6,561,471 | B1 | | 5/2003 | Hawie | 248/201 |
| 7,063,297 | B2 | | 6/2006 | Jopling | 248/292.12 |
| 7,077,711 | B1 | | 7/2006 | Moore | 439/864 |
| 7,603,960 | B1 | | 10/2009 | Perry et al. | 114/364 |

* cited by examiner

*Primary Examiner* — Robert J Sandy
*Assistant Examiner* — Abigail E Morrell
(74) *Attorney, Agent, or Firm* — Jonathan A. Bay

(57) ABSTRACT

A camming clamp has a fixed jaw, a pair anchored in the fixed jaw, and a moving jaw threaded onto the guides. A levered cam is threaded onto at least one guide. A backing surface is threaded onto the same one guide. It sandwiches the levered cam between itself and the moving jaw. An adjustable locking provision locks the backing surface at fixed positions along this guide with the levered cam. Wherein, the levered cam has a cam head with an over-center axis such that, when rolled on one side of the over-center axis the camming clamp is slack and adapted to position the jaws on opposite sides of an object to be clamped, and, when rolled over the other side of the over-center axis the jaws clamp tight on said object. The over-center axis prevents the cam head from auto-pivoting back to slack.

2 Claims, 8 Drawing Sheets

CAMMING CLAMP FOR GUNWALES OR PONTOON-BOAT RAILS

CROSS-REFERENCE TO PROVISIONAL APPLICATION(S)

This application claims the benefit of U.S. Provisional Application No. 61/340,824, filed Mar. 22, 2010 and was originally presented as U.S. Provisional Application No. 61/211,344, filed Mar. 26, 2009. All the foregoing patent disclosures are fully incorporated herein by reference.

BACKGROUND AND SUMMARY OF THE INVENTION

The invention relates to a gunwale clamp for boating accessories and, more particularly, to a camming clamp for gunwales or pontoon-boat rails such that the clamping and releasing (un-clamping) thereof can be done quickly by hand and without tools.

A number of additional features and objects will be apparent in connection with the following discussion of the preferred embodiments and examples with reference to the drawings.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains. In the drawings.

DETAILED DESCRIPTION OF THE PREFERRED EMBODIMENTS

FIGS. 1 through 6 show a first embodiment of a camming clamp 20 in accordance with the invention. This application is commonly-owned, commonly-invented with U.S. Pat. No. 7,555,994—Arnall, for a pontoon boat cover system. The intended field-of-use of the present invention comprises clamping the clamp 20 to gunwales and/or pontoon-boat rails (eg., pontoon boats don't formally have gunwales, but they have counterparts, which are rails).

The camming clamp 20 affords quick connection and disconnection to and from a gunwale or handrail and thereafter serve as a base on which to mount any number of various, interchangeable accessories. Such non-limiting examples include the pontoon-boat cover system in the above-referenced patent; rod holders; drink holders; as well as outboard hook for suspending a lantern, bait bucket or fish keep; and so on.

Figure 1:
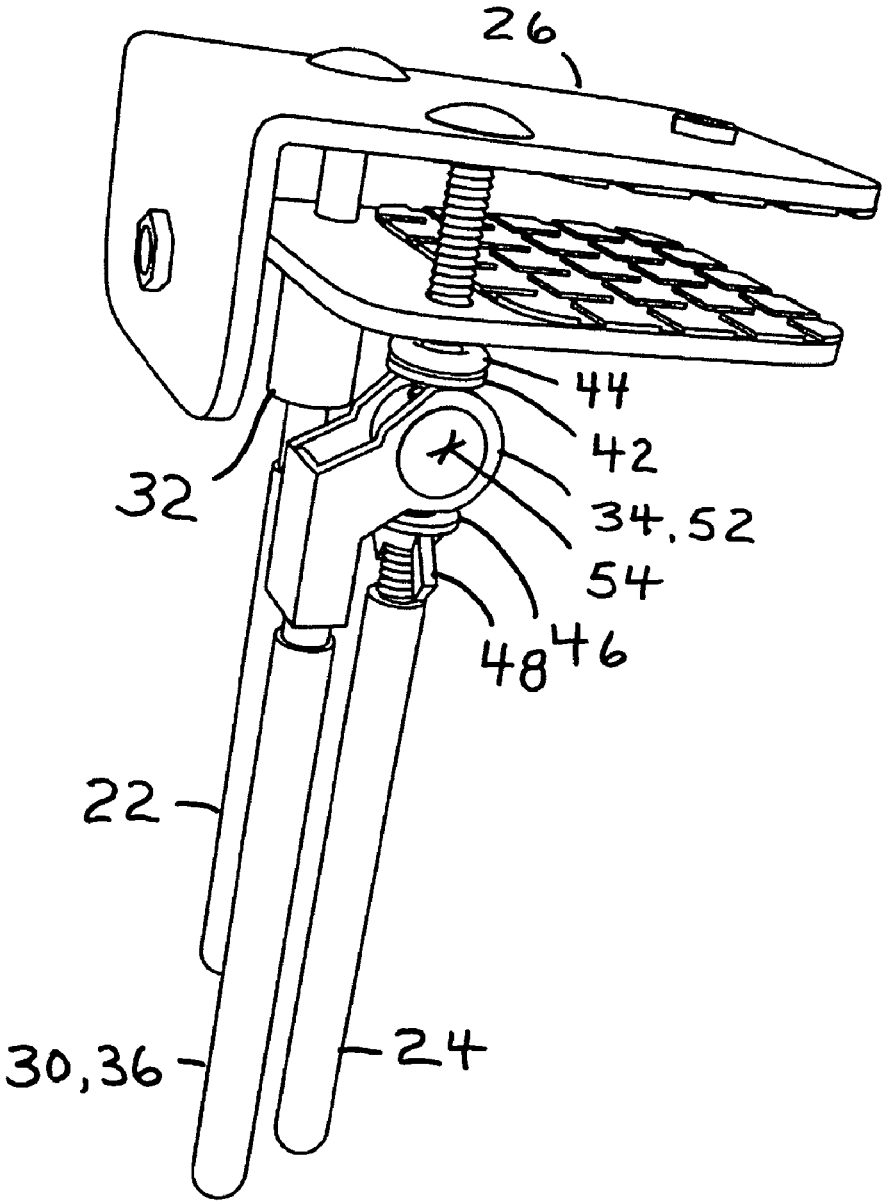
FIG. 1 is a perspective view of a first embodiment of a camming clamp in accordance with the invention.
Figure 5:
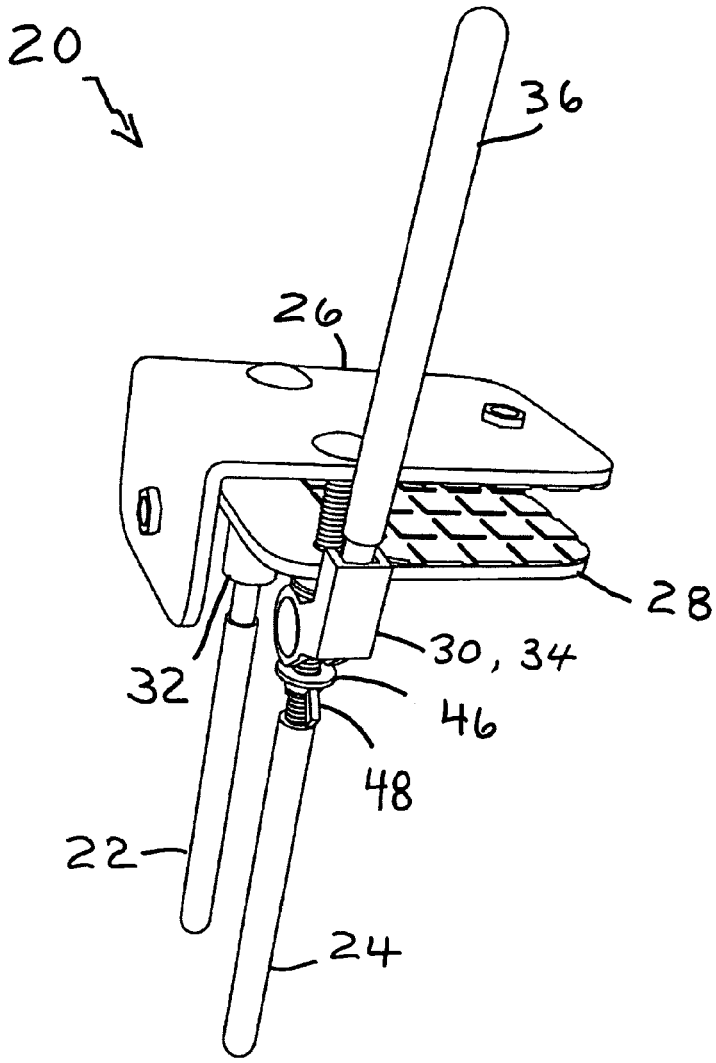
FIG. 5 is a perspective view comparable to FIG. 1 except likewise showing the lever inverted as in FIG. 4.
Figure 6:
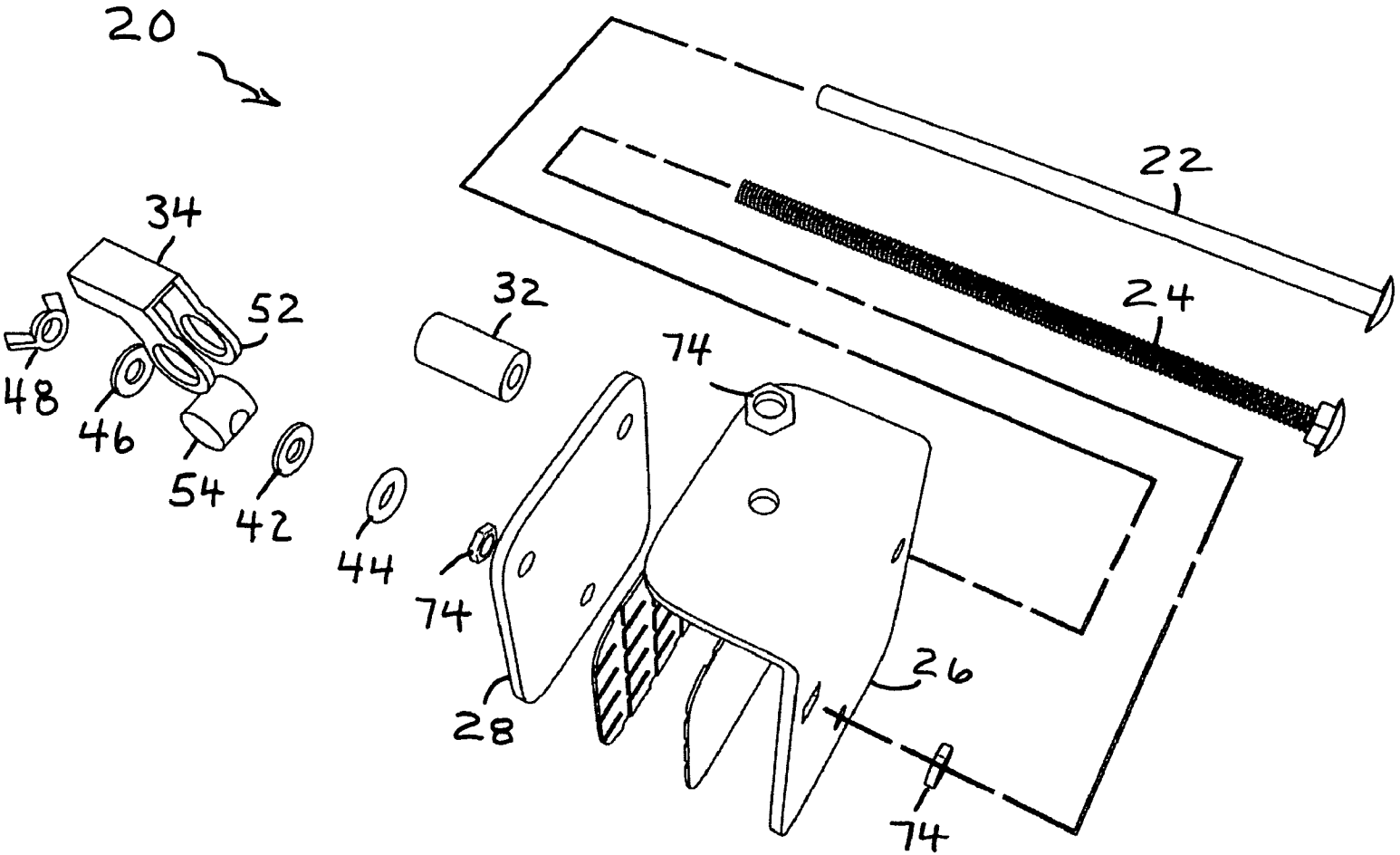
FIG. 6 is an exploded view of the first embodiment of the camming clamp in accordance with the invention.

As FIG. 6 shows better, the camming clamp 20 comprises two parallel rods 22 and 24. One rod 22 is a smooth rod and comprises a track 22. The other rod 24 is threaded 24. It is an option to employ a lag bolt as the threaded rod 24. In any event, the threaded rod 24 comprises the bite adjustment for the camming clamp 20. Wherein, the bite of the clamp 20 comprises the gap between the jaws 26 and 28 when clamped tight to an object (no object shown). FIG. 1 shows better that, the rods 22 and 24 are assembled to a fixed jaw 26 (ie., it being an L-shaped bracket), a moving jaw 28 (ie., a sliding plate), and a levered cam 30 that, when is shut, forces the moving jaw 28 into a clamped position. All of FIGS. 1 through 5 show the levered cam 30 in the shut, clamped-tight position.

The moving jaw 28 has a guide sleeved 32 rigidly affixed to it, preferably by welding or the like. The guide sleeve 32 is formed with a hollow cylindrical core. The track rod 22 is likewise rigidly affixed to the fixed jaw 26. Preferably this is also accomplished by welding or the like. The smooth rod 22 inserts through the hollow core of the guide sleeve 32. The tolerance between the hollow cylindrical core of the guide sleeve 32 and smooth cylindrical outer wall of the track rod 22 is tight such that there is very close clearance. That way, the guide sleeve 32 slides back forth on the track rod 22, maintaining the clamping surface of the moving jaw 28 very nearly parallel with the clamping surface of the fixed jaw 26. As an aside, preferably the guide sleeve 32 slides back forth on the track rod 22 such that it maintains the clamping surface of the moving jaw 28 very nearly perpendicular to the axis of the track rod 22 over the extent of its travel on the track rod 22.

The levered cam 30 comprises a cam head 34 and a lever arm 36 connected thereto (ie., the lever arm 36 is omitted from view in FIG. 6). The camming clamp 20 further comprises a loosely sliding washer 42 and resilient O-ring 44 inserted between the cam head 34 of the levered cam 30 and the moving jaw 28. There is also a backing washer 46 and lock nut 48 for the levered cam 30 for backing the cam head 34.

The jaws are optionally covered by grip pads. The rods and lever arm are optionally inserted in vinyl tube in order to better protect against scratching the finish of the gunwale or handrail.

The drawings show the lock nut(s) 48 as implemented by a wing nut. It is an option of the invention that wing nuts are a non-limiting example and that other kinds of nuts can be used, including nylon lock nuts (not shown). Nylon lock nuts hold their position on a threaded rod more firmly than a wing nut. However, nylon lock nuts can typically only be spun by a wrench (not shown), whereas wing nuts can be spun by hand.

In use, a user adjusts the lock nut 48 at the outset in order to fix the distance between the moving jaw 28 and fixed jaw 26 when the levered cam 30 is shut. In other words, a user sets the grip distance for a given gunwale or handrail upon an initial use. Once this setting is adjusted to, the user can repeatedly connect and disconnect the camming clamp 20 to the same given gunwale or handrail—quickly and without re-adjusting the lock nut 48's position—and without ever having to return to re-adjusting the original setting of the lock nut 48. That way, the camming clamp 20 can be put on quickly and taken off quickly, over and over again, on the water, and manually so as to not ever again have to resort to re-adjusting the lock nut 48's position. Importantly, this most significantly means without tools.

In use, the moving jaw 28 slides loosely on the pair of rods 22 and 24, as does the resilient O-ring 44 and the pair of washers 42 and 46 which flank the cam head 34 of the levered cam 30. The terminal lock nut 48 is set at a fixed distance away from the fixed jaw 26. The cam head 34 is produced from a rolled-half-plate to produce a pair of cam ears 52. The cam ears 52 have aligned holes through them to accept an apertured pivot pin 54. The pivot pin 54's aperture accepts the insertion of the respective threaded rod 24 and slides loosely thereon.

Figure 2:
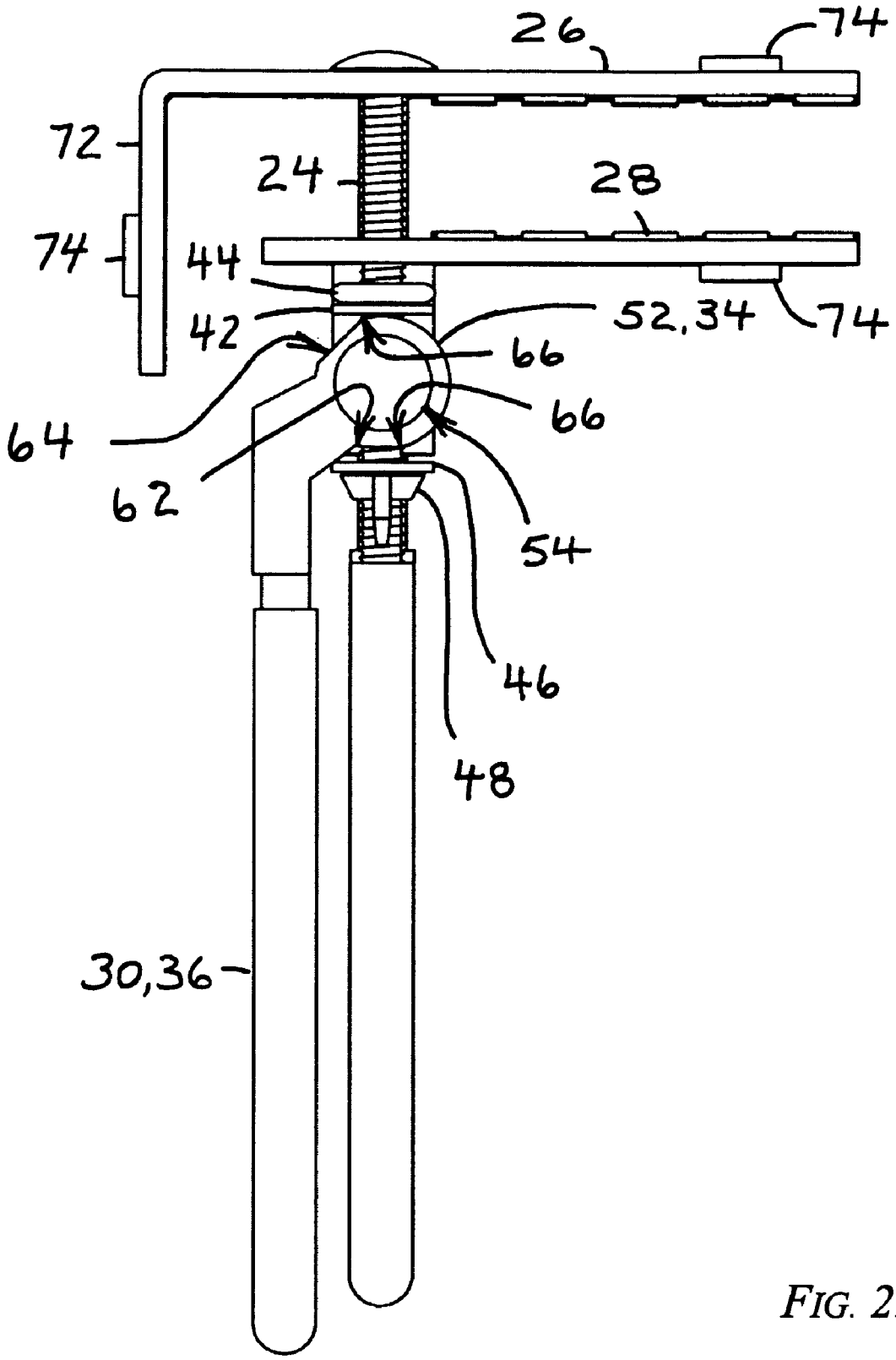
FIG. 2 is a side elevational view thereof.
Figure 3:
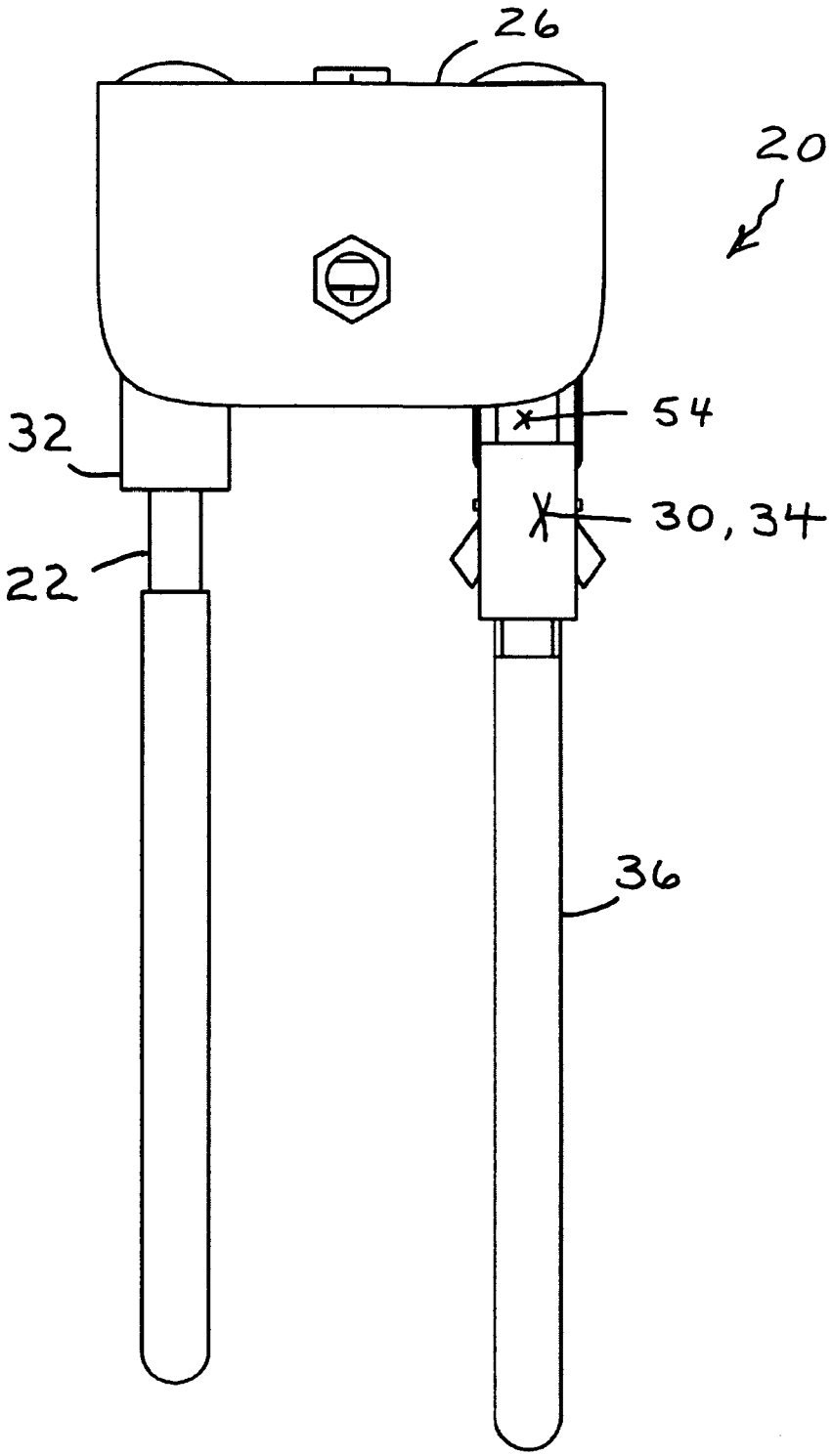
FIG. 3 is an elevational view thereof from a viewpoint 90° to the right of FIG. 2's.

The cam ears 52 of each cam head have an over-center axis 66-66. FIG. 2 shows the near-side (eg., near-side in the view) cam ear 52 pivoted past the cam ear 52's over-center axis 66-66. The resilient O-ring 44 allows the cam ears 52 to travel past the over-center axis 66-66 by squishing flat. Once the levered cam 30 shuts (as shown in FIG. 2), the cam ears 52 have gone past their over-center axis 66-66, and the O-ring 44 restores itself somewhat, but remains pretty squished all the same. The cam ears 52 have one flat surface 62 for the locking position. This flat surface 62 is backed by the backing washer 46 in the locked position. That way, the O-ring 44 applies a retaining force on the cam ears 52, which keeps the locking flat 62 abutted against the backing washer 46 and thereby prevents the cam ears 52 from freely pivoting open (eg., pivoting back across their over-center axes 66-66), which would detrimentally open the clamp 20.

When the clamp 20 is open, the lever arm 36 would be flared in FIG. 2 to about an 8 o'clock position (but this is not shown in FIG. 2). The cam ears 52 have a second flat surface 64 for the unlocked position. When the clamp 20 is open, the slack-position flat surface 64 more or less abuts the washer 42 that protects the O-ring 44. To roll the cam ears 52 back and forth between the flat surfaces 62 and 64 requires rolling two teeth 66 to force apart the washers 42 and 46 against the compressibility of the O-ring 44. The diameter (or chord) which stretches across the cam ears 52 and terminates in the diametrically opposite teeth 66 comprises the over-center-axis 66 for the cam ears 52.

Figure 4:
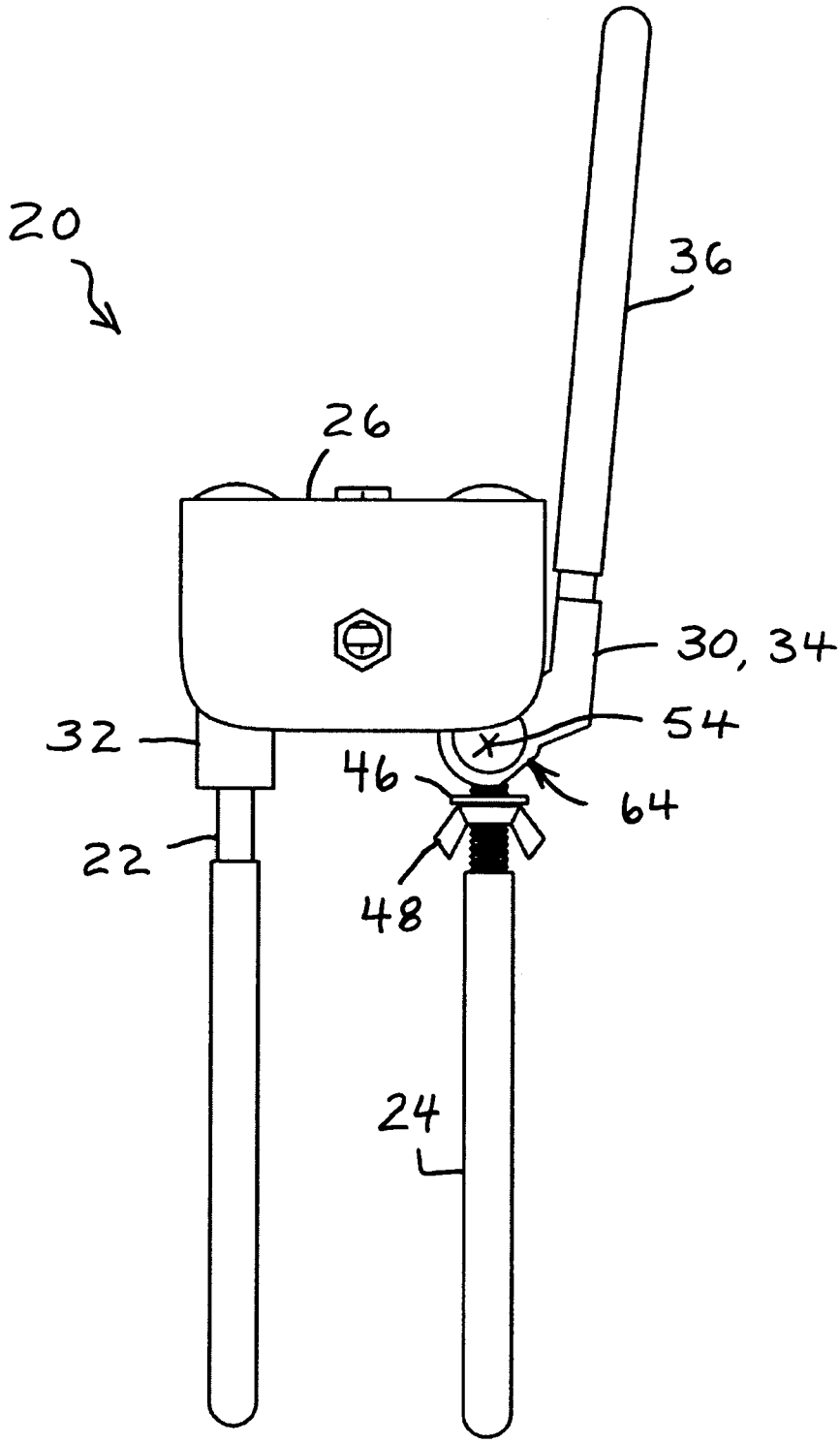
FIG. 4 is a reduced-scale elevational view comparable to FIG. 3 except showing the lever inverted.

FIGS. 4 and 5 show that the levered cam 30 can be taken completely off the threaded rod 24, inverted, and still be operable. Whereas in FIGS. 1 through 3, the lever arm 36 lies flush parallel alongside the threaded rod 24 when in the clamped shut position, FIGS. 4 and 5 show that the lever arm 36 points about 180° in the opposite direction in the clamped shut position. This provides the user convenience of orienting the clamp 20 in any orientation and having the lever arm 36 swing wherever wanted, preferably inside the boat rather than outboard.

In use, when the user has shut the levered cam 30 to the point of taking the slack out of the jaws 26 and 28, and is approaching rolling the cam ears 52 over their over-center-axes 66-66, it is also preferred if the following is true. That is, when the user prepares for the final squeeze to get the cam ears 52 to travel past the over-center axes 66-66 therefor, it is preferred if the final squeeze intentionally takes some muscle. Whereas the lever arm 36 does provide leverage, it is preferred that—in order to get tight and secure clamping pressure—the final squeeze requires a fairly hard squeeze in order get a good tight clamp on a gunwale or handrail.

Figure 7:
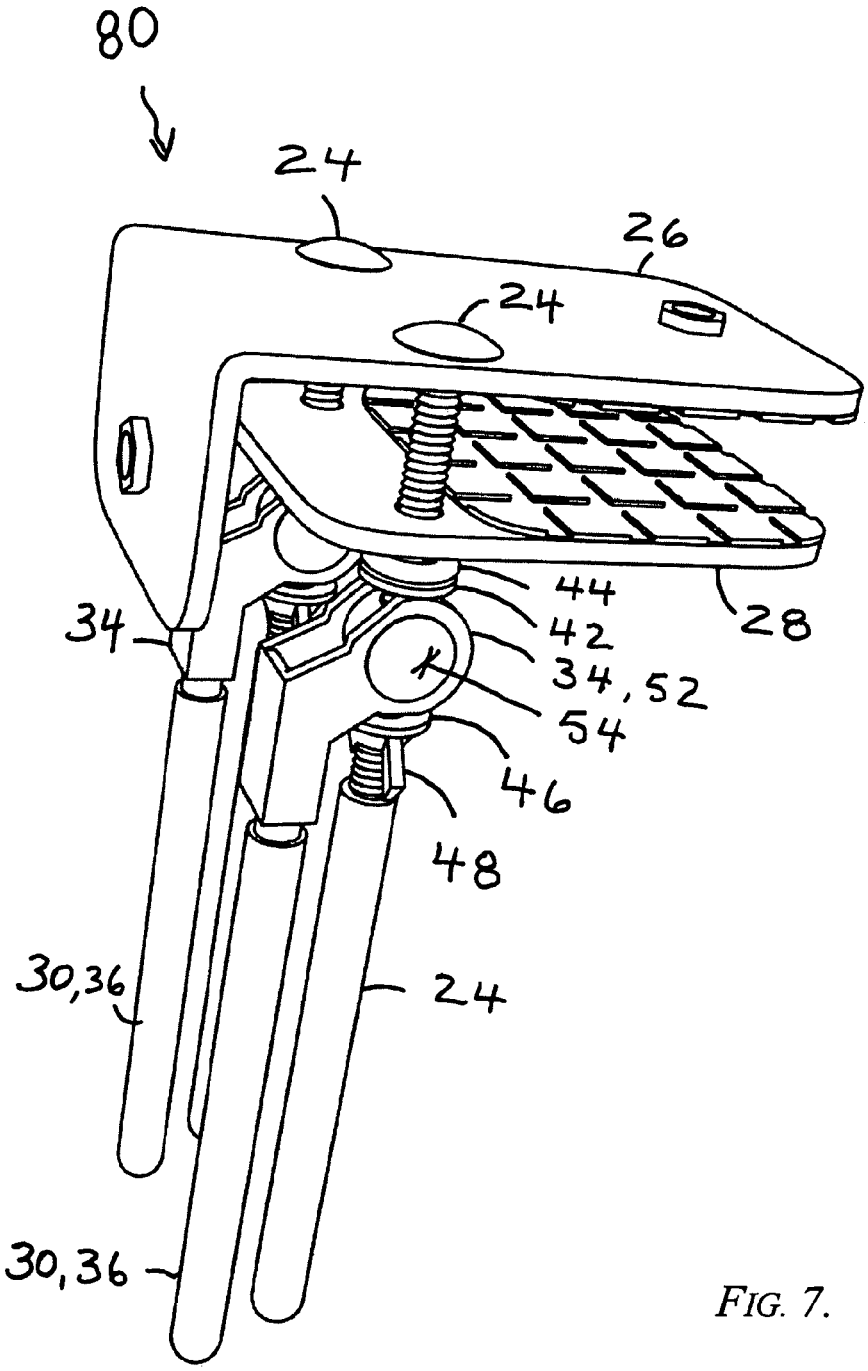
FIG. 7 is a perspective view comparable to FIG. 1 except of a second embodiment of a camming clamp in accordance with the invention.
Figure 8:
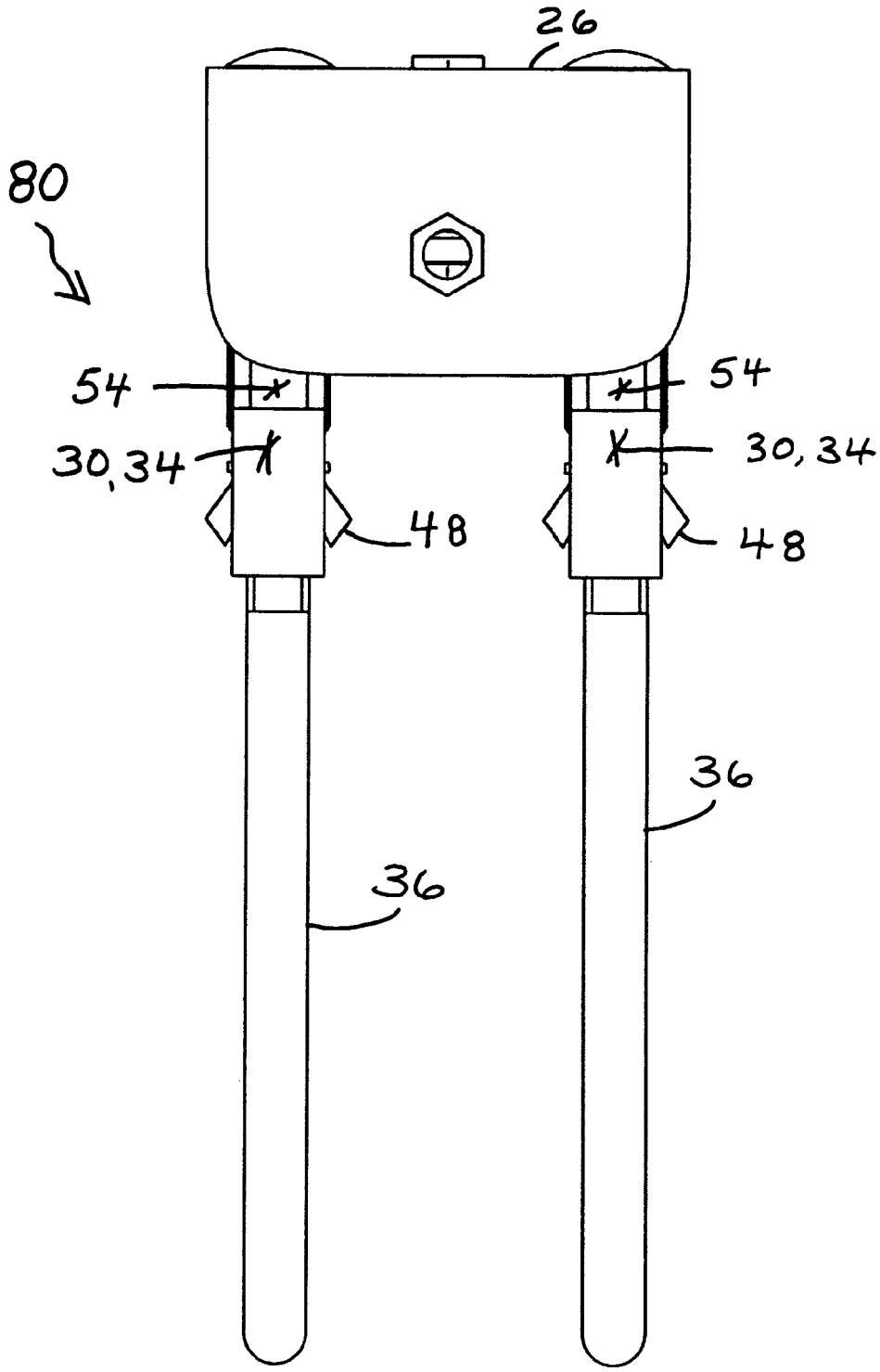
FIG. 8 is a perspective view comparable to FIG. 3 except of the second embodiment of a camming clamp in accordance with the invention.

FIGS. 7 and 8 show an alternate embodiment of a camming clamp 80 in accordance with the invention. In contrast to the first embodiment, the track rod 22 and guide sleeve 32 formations have been replaced with a twin of the levered cam 30 and threaded rod 24 of the first embodiment. Hence the alternate embodiment camming clamp 80 requires squeezing two lever arms 36 shut in order to get the clamp 80 to be clamped shut. FIGS. 7 and 8 both show the lever arms 36 in the shut position. When the lever arms 36 are shut, and there is a solid object in the jaws 26 and 28 of the clamp 80 (no object shown), the cam ears 52 have pivoted past their over-center axes 66-66. The squishing of the O-rings 44 permitted the cam ears 52 to pivot across their over-center axes 66-66 by going flat as possible. And now the squished O-rings 44 apply a continual expansion force on the cam ears 52 so that they cannot auto-pivot back across the over-center axis 66-66 in the absence of an external force:—namely, in the absence of the user pulling the lever arms 36 apart. Again, FIG. 2 provides a better view of a squished O-ring 44.

The jaws 26 and 28 comprise a series of threaded sockets 74 distributed around. As mentioned previously, the fixed jaw 26 is an L-shaped bracket. One leg serves as the fixed jaw 26, the other leg serves as a mounting base 72. Actually, the fixed jaw leg 26 as well as the moving jaw 28 also serve as mounts for accessory sockets 74, as both have threaded sockets 74 (welded-in nuts) which allows accessories to be twisted in on axes parallel with the parallel rods 22 and 24. In contrast, the mounting base 72 has a threaded socket 74 (eg., welded-in nut) which allows accessories to be twisted in on an axis perpendicular with the parallel rods 22 and 24. As oriented in FIG. 2, the mounting base 72 supports accessories which extend out over the water, while up the fixed jaw leg 26 supports accessories which extend up into the air. The moving jaw 28 would support accessories which extend over the boat's floor (no accessories shown).

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A camming clamp comprising:

a fixed jaw, a pair of guides affixed to and extending out from the fixed jaw, a moving jaw having a pair of apertures for threading onto the pair of guides, a levered cam threaded onto at least one of the guides, a backing surface threaded onto one guide of the pair guides with the levered cam and sandwiching the levered cam between said backing surface and said moving jaw, an adjustable locking provision for locking the backing surface at fixed positions along said one guide with the levered cam, wherein the levered cam has a cam head with an over-center axis such that, when the levered cam is pivoted in one direction, the cam head is rolled on one side of the over-center axis and the camming clamp is slack and adapted to position the jaws on opposite sides of an object to be clamped, and, when the levered cam is pivoted in an opposite direction, the cam head is rolled over the other side of the over-center axis and the jaws clamp tight on said object, whereby the over-center axis prevents the cam head from auto-pivoting back across the over-center axis in the absence of a user-applied external force.

2. The camming claim of claim 1 further comprising:

a bias element for biasing the cam head to one side of the over-center axis or the other side, but not stably axially aligned on the over-center axis.

* * * * *